United States Patent [19]

Bruguier

[11] 3,977,210

[45] Aug. 31, 1976

[54] HEAT EXCHANGER APPLICABLE MORE PARTICULARLY TO COMPRESSOR HEAT PUMPS

[75] Inventor: Jacques Bruguier, Talant, France

[73] Assignee: Societe Anonyme dite: Frimair S.A., France

[22] Filed: Nov. 12, 1974

[21] Appl. No.: 523,122

[30] Foreign Application Priority Data

Nov. 16, 1973 France ..... 73.40819
Oct. 16, 1974 France ..... 74.34732

[52] U.S. Cl. ..... 62/324; 165/96
[51] Int. Cl.[2] ..... F25B 13/00
[58] Field of Search ..... 62/324; 165/96

[56] References Cited

UNITED STATES PATENTS 2,537,276 1/1951 McMahon et al. ..... 165/97 X
2,715,317 8/1955 Rhodes ..... 62/324 X
3,770,050 11/1973 Nabanishi ..... 165/97

*Primary Examiner*—Albert W. Davis, Jr.
*Attorney, Agent, or Firm*—Robert E. Burns; Emmanuel J. Lobato; Bruce L. Adams

[57] ABSTRACT

A heat exchanger containing two heat-exchange fluids flowing in countercurrent irrespective of the direction of heat exchange selected.

In the specific case of a compressor heat pump, the exchangers 2 and 3 are provided with calibrated non-return valves 1A, 1B, 4A, 4B and 1C, 1D, 4C, 4D respectively to reverse the direction of flow of the fluid flowing in the heat pump for winter or summer operation. These valves automatically assume the required position when the four-way valve 5 of the compressor is actuated.

Application to compressor heat pumps.

3 Claims, 2 Drawing Figures

HEAT EXCHANGER APPLICABLE MORE PARTICULARLY TO COMPRESSOR HEAT PUMPS

BACKGROUND OF THE INVENTION

This invention relates to a heat exchanger using two fluids flowing in counter-current, and applicable more particularly to compressor heat pumps.

In such pumps, two heat-exchangers are used, one operating as a condenser and the other as an evaporator, i.e., two exchangers which operate in different heat exchange directions in relation to one another. In the case of a reversible heat pump, i.e. one for summer and winter operation, each exchanger must also operate as a condenser during part of the year and as an evaporator during the other part of the year.

To obtain optimum operation of such exchangers, irrespective of the heat exchange direction, the counter-current flow of the two fluids must be maintained in the two reverse operation cycles of the pump.

In the case of reversible compressor heat pumps in which the heat exchanges are effected between a refrigerant fluid and air in each of the two exchangers, there is no suitable arrangement of valve means which readily and inexpensively enables the counter-current heat exchange between air and the refrigerant fluid to be maintained in the two exchangers irrespective of the heat pump cycle, i.e., to reverse the direction of flow of one of the two fluids; or which enables the refrigerant fluid to be constantly injected in the gaseous phase in the top part of the exchanger acting as a condenser, and withdraw this fluid in the liquid phase from the bottom part of the exchanger acting as a condenser; or to enable pressure shocks to be attenuated when there is a change-over of the cycle.

SUMMARY OF THE INVENTION

The object of the invention is to provide all the above advantages.

It relates to a heat exchanger applicable more particularly to compressor heat pumps, using two fluids flowing in counter-current, and a system for changing over the direction of flow of one of the two fluids to maintain the counter-current flow of the two fluids irrespective of the direction of heat exchange, characterised in that the changeover system comprises a set of four valve means, two being respectively connected in series with each end of the pipes associated with one of the exchanger fluids while the other two are connected cross-wise to the ends of the first two.

In a first embodiment, the valve means are valves so controlled as to reverse the direction of flow. Electromagnetically controlled valves are generally used, but this system has the disadvantage of not being manually operable in the event of a power supply breakdown or a fault in the electromagnetic winding.

In a second embodiment, the valve means are calibrated non-return valves, the calibration of the non-return valves and their direction of passage being such that opening of the non-return valves takes place automatically as a result of the operating pressure applied to their input. The advantage of this system is that no special electric control system is required and it can be controlled directly and automatically on actuation of the winter-summer cycle changeover switch associated with the compressor. This system also enables pressure shocks to be attenuated.

BRIEF DESCRIPTION OF THE DRAWINGS

The invention will be more readily understood from one exemplified embodiment relating to a compressor heat pump and with reference to the accompanying drawings wherein:

FIG. 2 is the diagram corresponding to summer operation according to the invention.

DESCRIPTION OF THE PREFERRED EMBODIMENTS

Figure 1:
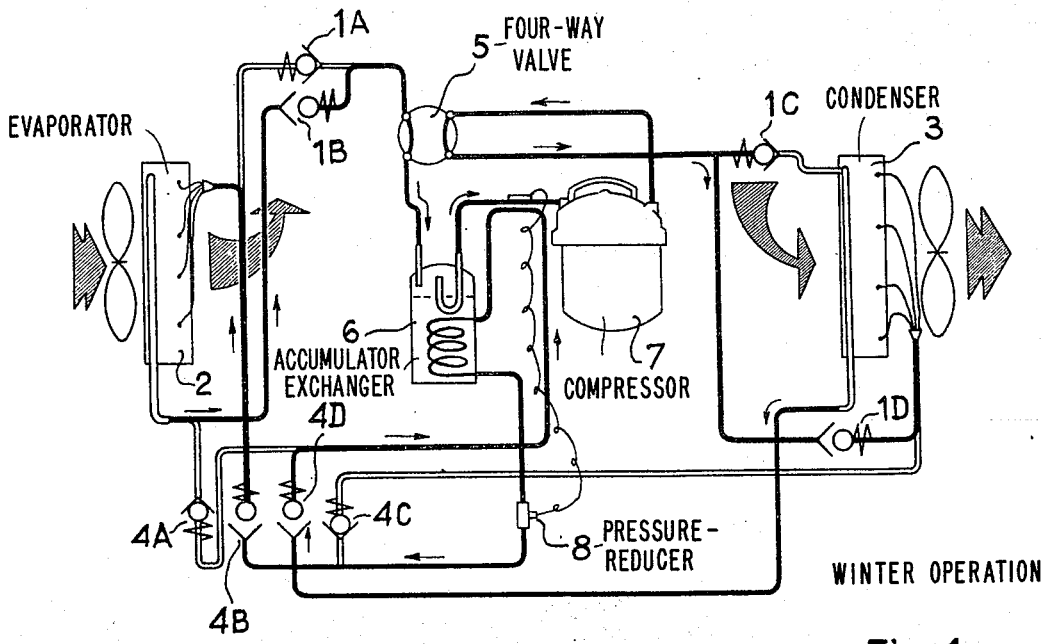
FIG. 1 is a diagram showing the fluid circuits in a heat pump for winter operation according to the invention.

The heat exchangers 2 and 3 contain two heat-exchange fluids, for example freon, the refrigerant fluid, and air blown by a fan. In FIG. 1, the outer exchanger 2 operates as an evaporator and the inner exchanger 3 operates as a condenser. In FIG. 2, on the other hand, the exchanger 2 operates as a condenser and exchanger 3 as an evaporator.

The thick-line piping carries the freon while the little arrows indicate the direction of flow. The large cross-hatched arrows show the direction of air flow.

The invention lies in the fact that a system for reversing the direction of the flow of the freon is added to each exchanger and comprises a set of four calibrated non-return valves 1A, 1B, 4A, 4B. One of these valves 1A is in series in the top pipe of the exchanger 2 while the other valve 1B shunts the system comprising the valve 1A and the exchanger 2. The valve 4A is in series with the bottom pipe of the exchanger 2 while the other valve 4B shunts the system comprising the valve 4A and the exchanger 2. The valves 1B and 4B are therefore connected cross-wise to the ends of the valves 1A and 4A.

The valves 1C, 1D, 4C, 4D corresponding to the other exchanger 3 are disposed in the same way as the foregoing. FIGS. 1 and 2 show the valves which are opened for each state of operation, i.e. winter and summer. The air and the freon thus flow in counter-current in the exchangers 2 and 3 in every case.

Apart from these systems for reversing the direction of flow of the freon, the diagram shows the well-known components of a conventional heat pump, e.g. a four-way valve 5, for example of the electromagnetic type with two positions, i.e. winter-summer, an accumulator-exchanger 6, a compressor 7, and a pressure reducer 8.

The above-mentioned eight calibrated non-return valves are disposed in the pipes in a direction such that they are in the closed position when they are required to prevent the passage of fluid, and are in the open position when their input pressure is higher than the output pressure plus the pressure of the calibration spring.

We shall take the case of valve 1A as an example:

In winter operation as shown in FIG. 1, the pressure on the left-hand side of this valve, i.e. its output, is higher than that at its input (right-hand side); the action of the spring is added to that of the resultant pressure to hold the valve closed.

In the summer operation shown in FIG. 2, the pressure exerted at the input of valve 1A is greater than that exerted at the output of said valve, but there is the spring which tends to hold the valve closed. For the valve to open, the spring must be designed not to withstand the pressure difference between the valve input and output. In these conditions, the valve will open to allow the fluid to pass. The same applies to all the other valves.

For example, the four-way valve 5 only has to be set to one of its two winter-summer positions for the calibrated non-return valves automatically to assume the appropriate position without any pressure shock.

The Figures show the specific arrangement of the collector of the exchanger 3 with an outlet orifice at the top and another at the bottom. This enables freon to be discharged in the gaseous phase via the top of the collector in the case of FIG. 2.

It will also be noted that the liquid phase is discharged at the bottom of the exchanger operating as a condenser (reference 3 in FIG. 1 and reference 2 in FIG. 2).

The invention thus enables the operation and control system of a compressor heat pump to be considerably simplified, particularly in the case of a pump in which the two exchangers are of the refrigerant fluid and air type.

If controlled valves are used instead of non-return valves, the said controlled valves are advantageously controlled so as to obviate any pressure shocks in the piping.

I claim:

1. A heat exchanger system operating with a fluid having both a liquid and gaseous phase, including:

a fluid circuit for a fluid having a liquid phase when compressed and cooled and a gaseous phase when heated and at a reduced pressure, a pair of heat exchangers in said fluid circuit, both of which can operate alternatively as a condenser and an evaporator, compressor means connected in said fluid circuit to said heat exchangers for compressing said fluid when in a gaseous phase, an accumulator-exchanger connected in said fluid circuit to said compressor means and a pressure reducer connected with the accumulator exchanger, for each heat exchanger four non-return valve means in said fluid circuit connected for maintaining inside each said exchanger the flow direction of the fluid during condensing and evaporating operation thereof, a changeover valve in said fluid circuit associated with the compressor means, the accumulator exchanger and the pressure reducer, to maintain inside these three components the same direction of fluid flow, said changeover valve having means operable to a first position controlling the fluid under pressure for setting the non-return valves so that the fluid flow causes a first heat exchanger to operate as an evaporator, and a second heat exchanger to operate as a condenser, thereby heating incoming air to the system, the last-mentioned means being operable to a second position controlling the fluid under pressure for setting the non-return valves so that the first heat exchanger operates as a condenser, and the second heat exchanger operates as an evaporator, thereby cooling incoming air to the system.

2. A heat exchanger system according to claim 1, wherein said valve means each comprises a non-return spring-biased valve, each valve means comprising a biasing spring arranged such that the valve will open when the pressure differential there across exceeds a predetermined value.

3. A heat exchanger system according to claim 1, wherein at least one exchanger is provided with a collector tube having two fluid outlets, the one outlet at its upper part, the other outlet at its lower part.

* * * * *